US005882237A

United States Patent [19]

Sarver et al.

[11] Patent Number: 5,882,237

[45] Date of Patent: Mar. 16, 1999

[54] FLUORESCENT LAMP CONTAINING A MERCURY ZINC AMALGAM AND A METHOD OF MANUFACTURE

[75] Inventors: James F. Sarver, Chesterland, Ohio; Duane A. Stafford, Champaign, Ill.; Steven C. Hansen; Timothy R. Brumleve, both of Urbana, Ill.

[73] Assignee: Advanced Lighting Technologies, Inc., Solon, Ohio

[21] Appl. No.: 833,256

[22] Filed: Apr. 4, 1997

Related U.S. Application Data

[62] Division of Ser. No. 299,292, Sep. 1, 1994.

[51] Int. Cl.[6] ..... H01J 9/395

[52] U.S. Cl. ..... 445/9

[58] Field of Search ..... 445/9, 26; 313/490

[56] References Cited

U.S. PATENT DOCUMENTS

| | | | |
|---|---|---|---|
| 2,467,687 | 4/1949 | Noel | 313/639 |
| 3,336,502 | 8/1967 | Gilliatt | 313/490 |
| 4,105,910 | 8/1978 | Evans | 313/490 |
| 4,145,634 | 3/1979 | Evans et al. | 313/490 |
| 4,216,178 | 8/1980 | Anderson | 264/9 |

*Primary Examiner*—Kenneth J. Ramsey
*Attorney, Agent, or Firm*—Roger & Killeen

[57] ABSTRACT

A fluorescent lamp containing zinc amalgam and a method of precisely controlling the amount of mercury introduced into a temperature controlled fluorescent lamp. Precise quantities of mercury may be introduced into a fluorescent lamp in the form of solid zinc amalgam pellets that are in a metastable, non-equilibrium state.

16 Claims, 2 Drawing Sheets

FLUORESCENT LAMP CONTAINING A MERCURY ZINC AMALGAM AND A METHOD OF MANUFACTURE

This is a division, of application Ser. No. 08/299,292, filed Sep. 1, 1994.

BACKGROUND OF THE INVENTION

The present invention relates to conventional fluorescent lamps in which the mercury vapor pressure is controlled by controlling the temperature of the lamps that heretofore have been dosed with liquid mercury, and more particularly to such lamps containing mercury in the form of a zinc amalgam that, in contrast to the predicted equilibrium condition, is in a metastable, non-equilibrium state.

All fluorescent lamps contain mercury which is vaporized during lamp operation. The mercury vapor atoms efficiently convert electrical energy to ultraviolet radiation with a wavelength of 253.7 nm when the mercury vapor pressure is in the range of approximately $2\times10^{-3}$ to $2\times10^{-2}$ torr (optimally about $6\times10^{-3}$ torr). The ultraviolet radiation is in turn absorbed by a phosphor coating on the interior of the lamp wall and converted to visible light. The temperature of the coldest spot on the inner wall of the lamp when the lamp is operating is referred to as the "cold spot temperature" and will determine the mercury vapor pressure within the lamp.

When a lamp containing only mercury operates with a cold spot temperature above about 40° C., the mercury vapor pressure will exceed the optimal value of $6\times10^{-3}$ torr. As the temperature increases, the mercury vapor pressure increases and more of the ultraviolet radiation is self-absorbed by the mercury, thereby lowering the efficiency of the lamp and reducing light output.

The mercury vapor pressure may be maintained within the desired range either by controlling the cold spot temperature of the lamp (hereinafter referred to as "temperature control") or by introducing other metallic elements into the lamp in the form of amalgams that maintain the mercury vapor pressure (hereinafter referred to as "amalgam control"). For example, fluorescent lamps that have cold spot temperatures above about 75° C., such as some types of small diameter, low wattage fluorescent lamps generally known as "compact" fluorescents, are amalgam controlled in that they typically require two or more elements in addition to mercury which may be introduced into the lamp as solid ternary or multicomponent amalgams. Such amalgam controlled lamps rely on establishment of thermodynamic equilibrium for proper lamp operation (see, for example, U.S. Pat. No. 4,145,634 issued Mar. 20, 1979 to Evans, et al.).

The present invention is directed to temperature controlled fluorescent lamps.

Temperature controlled fluorescent lamps may operate with a cold spot temperature below about 75° C. (typically ranging from 20° to 75° C.) and desirably 40° C. to 60° C. Such lamps are also referred to as "low temperature" fluorescent lamps.

In temperature controlled lamps (e.g., ceiling mounted fluorescent lamps) the mercury is typically introduced into the lamp as a liquid in an amount related to the wattage and rated life of the lamp. For example, 10–15 milligrams of liquid mercury are typically needed to attain an average rated life of 20,000 hours for a 40 watt fluorescent lamp.

However, the high speed, automated manufacturing processes typically used to dose each lamp with liquid mercury lack precision because of the nature of the liquid mercury, the length and configuration of the path by which introduced, and the atomization of the mercury by the high velocity puff of inert gas used to effect introduction. As a result of the variability in the amount of mercury which reaches the lamp, a considerable excess of liquid mercury is used to insure that at least the minimum amount of liquid mercury is introduced into each lamp. Some of the known manufacturing processes allot an average of three to five times the amount of liquid mercury needed to achieve average rated life. Thus, most lamps receive far more mercury than is needed, even up to ten times the amount needed, to achieve the average rated life.

This use of excessive amounts of liquid mercury is wasteful and may produce very unfavorable consequences. For example, only part of the total amount of liquid mercury introduced into the lamp is converted to vapor when the lamp is operating leaving droplets of liquid mercury that cause dark spots on the lamp that are aesthetically undesirable. Further, and perhaps more significantly, mercury is toxic and lamp disposal is becoming a significant issue throughout the world. Thus, it is clearly desirable to manufacture fluorescent lamps with the minimum amount of mercury needed to meet the average rated life.

Accordingly, it is an object of the present invention to obviate many of the above discussed problems and to provide a novel fluorescent lamp which contains a controlled amount of mercury.

It is another object of the present invention to provide a novel temperature controlled fluorescent lamp which contains mercury in the form of a zinc amalgam.

It is yet another object of the present invention to provide a novel fluorescent lamp in which mercury is introduced into the lamp in the form of a solid binary amalgam and which retains most of the second constituent of the binary amalgam (e.g., zinc) in solid form during lamp operation.

It is still another object of the present invention to provide a novel lamp fill material for a temperature controlled fluorescent lamp that is solid and easily handled at temperatures below about 40° C.

It is a further object of the present invention to provide a novel method of introducing a precise amount of mercury into a temperature controlled fluorescent lamp.

It is yet a further object of the present invention to provide a novel method of dosing a fluorescent lamp with a solid, reducing the total mercury by allowing more accurate and reliable dosing.

These and many other objects and advantages of the present invention will be readily apparent to one skilled in the art to which the invention pertains from a perusal of the claims, the appended drawings, and the following detailed description of preferred embodiments.

DESCRIPTION OF PREFERRED EMBODIMENTS

Figure 1:
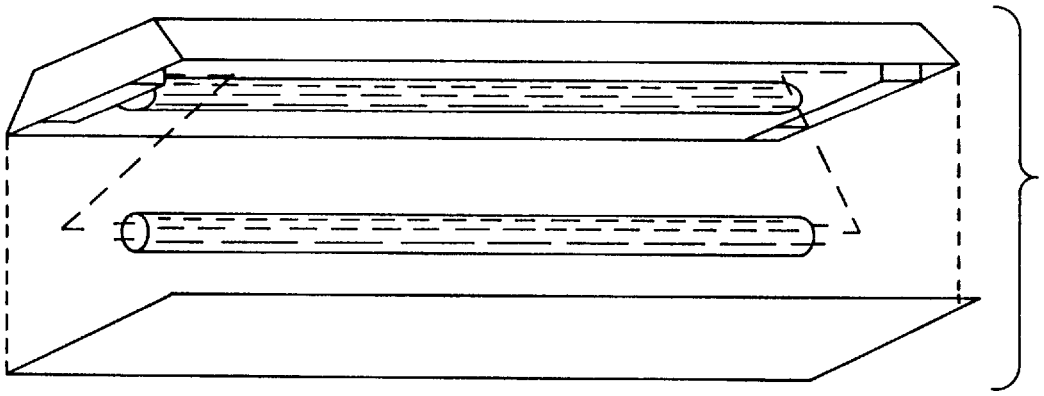
FIG. 1 is a pictorial view of one embodiment of the lamp of the present invention.

One embodiment of the novel fluorescent lamp of the present invention is illustrated in FIG. 1. It may be of standard size suitable for installation and use in conventional ceiling fixtures and contains mercury in the form of a zinc amalgam.

The amalgam may be binary, that is, consisting only of zinc and mercury (and with such minor impurities as may be introduced in the manufacturing process), or may consist substantially of zinc and mercury with a small portion (typically less than about 10 weight percent) of such other materials as may be appropriate (for example, bismuth, lead, indium, cadmium, tin, gallium, strontium, calcium and/or barium). The amalgam is desirably better than 99% pure and generally free of oxygen and water.

The amalgam is desirably about 5 to 60 weight percent mercury (about 3 to 33 atomic percent), with 40 to 60 weight percent mercury being preferred to reduce the amount of zinc introduced into the lamp. As shown in the published zinc-mercury phase diagram of FIG. 2, the amalgam in the desired percent weight range is predicted to be a solid at room temperature, to begin melting between 20° C. and 42.9° C., and to be completely molten between 280° C. (60 weight percent) and 400° C. (5 weight percent). As discussed in more detail below, the amalgam may not have the predicted characteristics, and may not be at equilibrium. The amalgam may be in a metastable, non-equilibrium state.

Figure 2:
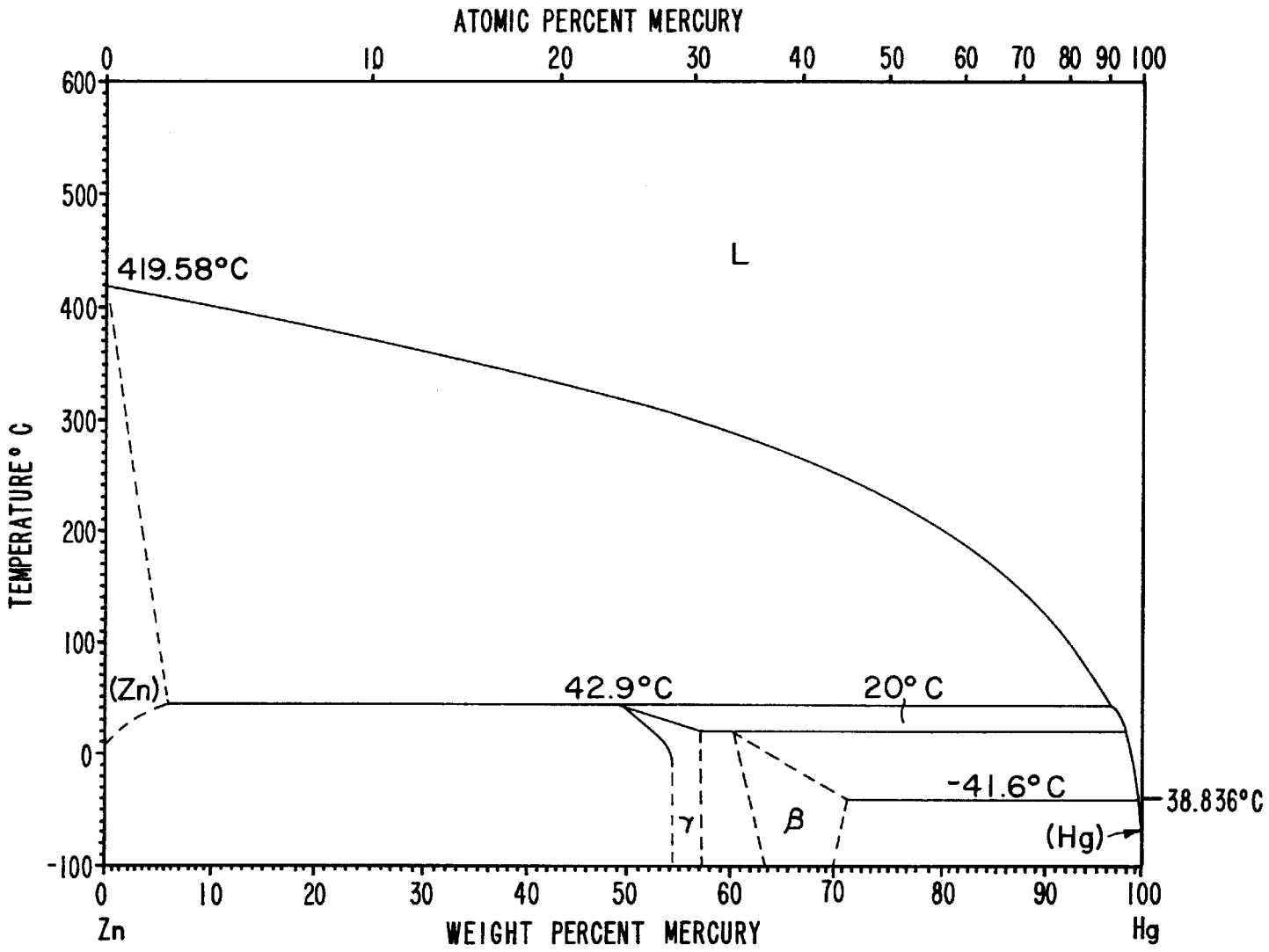
FIG. 2 is the published zinc-mercury equilibrium phase diagram.

With continued reference to FIG. 2, the equilibrium binary amalgam above 42.9° C. consists of a liquid phase containing a relatively small portion of the zinc in solution and a solid phase containing the balance of the zinc in a solid solution. For example, when the temperature of a 50 weight percent mercury amalgam exceeds 42.9° C., about one-half the amalgam is in a liquid phase producing a pool that is about 95% mercury by weight. This mercury rich liquid provides sufficient mercury vapor for efficient lamp operation. The amalgam which remains in the solid phase contains more than 90% zinc by weight. These conditions are typically achieved during lamp manufacture and operation.

As shown in the equilibrium phase diagram of FIG. 2, the 50 weight percent zinc-mercury amalgam is solid below 42.9° C. In contrast to the liquid mercury used in conventional temperature controlled fluorescent lamps, the amalgam of the present invention is a solid at room temperature so that it may be accurately dispensed and conveniently stored.

Because the amalgam is a solid at room temperature, the amount of amalgam that is to be introduced into a lamp may be easily quantified and dispensed. For example, small pellets of generally uniform mass and composition may be formed with any shape that is appropriate for the manufacturing process, although spheroidal pellets are the most easily handled and are thus preferred. Pellet diameter is desirably about 200 to 2000 microns.

Spheroidal pellets of generally uniform mass and composition may be made by rapidly solidifying or quenching the amalgam melt, such as by the apparatus and processes disclosed in U.S. Pat. No. 4,216,178 dated Aug. 5, 1980 (and those patents issuing from related applications) all assigned to the assignee of the present invention. The disclosure of said patents is hereby incorporated herein by reference.

These processes can be used to manufacture spheroidal pellets of predetermined and uniform mass (±10%) in the range from 0.05 milligrams to 25 milligrams. Other techniques for making the pellets, such as die casting or extrusion, are known and may be used. The pellets may be weighed, counted or measured volumetrically and introduced into the lamp by means of existing devices or other yet to be developed techniques. For example, a lamp that requires 10 mg of mercury may use 10 pellets, each 50 weight percent mercury and weighing 2 milligrams, or it may use one 20 milligram pellet of similar composition.

The zinc amalgam pellets manufactured by the rapid solidification or quenching processes discussed above have a structure that is different from that obtained by equilibrium freezing. That is, they do not necessarily melt or freeze in accordance with the published zinc-mercury phase diagram shown in FIG. 2. For example, the pellets have a partial zinc-rich exterior shell, and an interior with a random distribution of zinc-rich islands in a mercury-rich matrix. The intergranular regions are wetted with a mercury-rich liquid that remains stable (i.e., does not approach equilibrium) in the liquid phase when the pellets are stored at about 20° C. for several years even though the equilibrium phase diagram (FIG. 2) predicts that all phases are solid below 42.9° C. The rapidly solidified pellets have a porous structure that permits rapid gaseous diffusion of mercury vapor from the interior of the pellets. Further, the rigid structure of the pellets is maintained at temperatures up to 175° C.

It has been found that the vapor pressure of the mercury in the lamps at temperatures over 42.9° C. is enhanced over that which would be expected by thermodynamic calculations, a finding consistent with the non-equilibrium structure of the pellets. At temperatures below 42.9° C. the mercury vapor pressure is greater than 93% that of pure mercury, a finding consistent with the intergranular regions of the pellets that are wetted with a mercury-rich liquid. Thus, lamps dosed with the amalgam pellets have a mercury vapor pressure, and more significantly lamp performance, comparable to that of lamps dosed with pure liquid mercury, while providing ease and accuracy of dosing not available in liquid mercury dosed lamps. In contrast to amalgam controlled lamps, equilibrium of the amalgam need not be established.

Further, the porous structure allows rapid release of the mercury and rapid lamp start. The stability of this nonequilibrium structure indicates that the lamps of the present invention will operate over their rated life without mercury starvation and without recombination of released mercury with the pellets. The rigidity of the structure up to 175° C. improves manufacturability, even at the high temperatures that may be encountered in a manufacturing plant.

While preferred embodiments of the present invention have been described, it is to be understood that the embodiments described are illustrative only and the scope of the invention is to be defined solely by the appended claims when accorded a full range of equivalence, many variations and modifications naturally occurring to those skilled in the art from a perusal hereof.

What is claimed is:

1. A method of dosing a temperature controlled fluorescent lamp characterized in that, the mercury is provided in a zinc amalgam comprising more than 45 weight percent mercury, said amalgam being a solid below about 40° C. and partially solid and partially liquid at the operating temperature of the lamp; and the amalgam is introduced into the lamp as a solid.

2. The method of claim 1 wherein the amalgam is introduced into the lamp in the form of one or more pellets.

3. The method of claim 2 wherein the pellets are formed by rapid solidification of the amalgam so that each of the pellets has a zinc-rich outer shell and an interior with mercury-rich liquid portions.

4. The method of claim 1 wherein said amalgam is between 45 and 60 weight percent mercury.

5. The method of claim 1 wherein said amalgam is binary.

6. A method of dosing a fluorescent lamp with mercury in which the lamp fill material maintains a mercury vapor pressure not significantly different from the vapor pressure of pure mercury, characterized in that the method includes, providing an amalgam comprising more than 45 weight percent mercury.

7. The method of claim 6 wherein the amalgam is a zinc amalgam.

8. The method of claim 6 wherein the amalgam is introduced into the lamp in the form of pellets that are in a metastable, non-equilibrium state.

9. A method comprising the steps of:

(a) providing a fluorescent lamp;

(b) providing mercury in a zinc amalgam; and (c) introducing the amalgam into said lamp in the form of one or more pellets formed by rapid solidification of the amalgam.

10. The method of claim 9 wherein said zinc amalgam comprises more than 45 weight percent mercury.

11. The method of claim 9 wherein said pellets comprise a zinc-rich outer shell and an interior with mercury-rich liquid portions.

12. The method of claim 9 wherein said pellets are in a metastable, non-equilibrium state.

13. The method of claim 9 wherein said pellets are uncoated.

14. A method of dosing a temperature controlled fluorescent lamp with mercury, said method comprising the step of introducing the mercury into said lamp in the form of a zinc amalgam wherein said amalgam exists in solid and liquid phases when the lamp is operating and wherein the mercury concentration is less than 50 weight percent in the solid phase and more than 50 weight percent in the liquid phase.

15. A method of dosing a fluorescent lamp with mercury, said method comprising the step of introducing the mercury into said lamp in the form of an amalgam wherein said amalgam is in a metastable, non-equilibrium state and wherein the amalgamative metal does not have a significant effect on the vapor pressure of the mercury when the lamp is operating.

16. A method of dosing a fluorescent lamp with mercury, said method comprising the step of introducing the mercury into the lamp in the form of one or more zinc amalgam pellets having a zinc-rich outer shell and an interior with mercury-rich liquid portions.

* * * * *